US005903523A

United States Patent [19]

Peck

[11] Patent Number: 5,903,523

[45] **Date of Patent: *May 11, 1999**

[54] TIME ANALYZER HAVING AN IMPROVED INTERPOLATOR WITH TEMPERATURE COMPENSATION

[75] Inventor: Jeffrey V. Peck, Knoxville, Tenn.

[73] Assignee: EG & G Instruments, Inc., Oak Ridge, Tenn.

[ * ] Notice:

This patent issued on a continued prosecution application filed under 37 CFR 1.53(d), and is subject to the twenty year patent term provisions of 35 U.S.C. 154(a)(2).

[21] Appl. No.: 08/747,145

[22] Filed: Nov. 8, 1996

[51] Int. Cl.[6] ..... G04B 17/20

[52] U.S. Cl. ..... 368/202

[58] Field of Search ..... 368/201, 202, 368/11, 156, 159

[56] References Cited

PUBLICATIONS

M. Lampton and R. Raffani, "A High–Speed Wide Dynamic Range Time–to–Digital Converter", *Rev. Sci. Instrum.* 65 (11) (Nov. 1994).

A. Berry, "Dual Time to Digital Converter for Delay–Line Readout of Position–Sensitive Gas–Filled Detectors", *Rev. Sci. Instrum.* 64 (5), (May 1993).

*Primary Examiner*—Bernard Roskoski

*Attorney, Agent, or Firm*—Pitts & Brittian, P.C.

[57] ABSTRACT

A time analyzer having an improved interpolator with temperature compensation. The time analyzer of the present invention can be operated in a wide range of temperatures without need of recalibration in the field. The device includes hardware for making a coarse time measurement. A fine time measurement is obtained by interpolating within a cycle of the master clock. A temperature correction look up table is produced which incorporates information unique to each analyzer. Information stored in the look up table of each instrument is used to correct time measurement for enhanced precision.

19 Claims, 6 Drawing Sheets

TIME ANALYZER HAVING AN IMPROVED INTERPOLATOR WITH TEMPERATURE COMPENSATION

TECHNICAL FIELD

This invention relates to a time analyzer such as a spectrometer having an improved interpolator with temperature compensation, and more particularly concerns a time analyzer which can be operated in a wide range of temperatures without the need for recalibration in the field.

BACKGROUND

Time analyzers are commonly used for high resolution, multiple-stop time spectrometry. Such analyzers can be used to record event times in the microsecond range. Moreover, picosecond precision may be desirable for applications in time-of-flight (TOF) mass spectrometry, photon timing and in pulse or signal jitter analysis. It has been heretofore known that time analyzers can be based on a coarse counter and an interpolation method in which the interpolation enhances the time resolution. Known prior art technology relating to such interpolators can be found in a paper published by M. Lampton and R. Raffanti entitled "A High-Speed Wide Dynamic Range Time-To-Digital Converter". *Rev. Sci. Instrum.* 65 (11), November, 1994. A further interpolator technique is disclosed in an article by Andrew Barry entitled "Dual Time to Digital Converter for Delay-Line Readout of Position-Sensitive-Gas-Field Detectors". *Rev. Sci. Instrum.* 64 (5), May, 1993. These publications which are incorporated by reference and submitted with this application disclose technology related to mapping from acquired quadrature samples to interpolated time. The mapping functions thus produced compensate for certain system imperfections and allow for more accurate mapping and better instrument performance. However, such techniques and instruments do not provide for temperature compensation such that the analyzer can be used at various temperatures common in practical applications without either performance degradation or instrument recalibration in the field.

Accordingly, it is an object of the present invention to provide a time analyzer that enables precision, high resolution time measurement over a wide operating temperature range without the need for recalibration in the field. Another object of the present invention is to provide such a time analyzer which achieves high precision operation through temperature compensation. In prior art where an instrument requires a continuous supply of samples to maintain calibration, sparse measurements cannot be made inasmuch as there is a minimum throughput requirement. Thus, a further object of the present invention is to allow greater time measurement precision to be achieved by a practical analyzer which can be operated over a selected temperature range without putting restrictions on minimum sample throughput. Other objects and advantages of the instrument will become apparent upon reading the detailed description together with the drawings described as follows.

SUMMARY OF THE INVENTION

Other objects and advantages of the present invention will be recognized upon reading the attached disclosure of the improved time analyzer and method of calibrating such analyzer. The analyzer and method include circuitry and steps for making a coarse time measurement for determining the cycle of the master clock within which an event occurs. A fine time interpolation is then accomplished for determining the time interval within the cycle of the master clock at which the event occurs. A temperature correction is then made on the fine time measurement such that the analyzer produces a time analysis measurement which is temperature compensated.

BEST MODE FOR CARRYING OUT THE INVENTION

Figure 8:
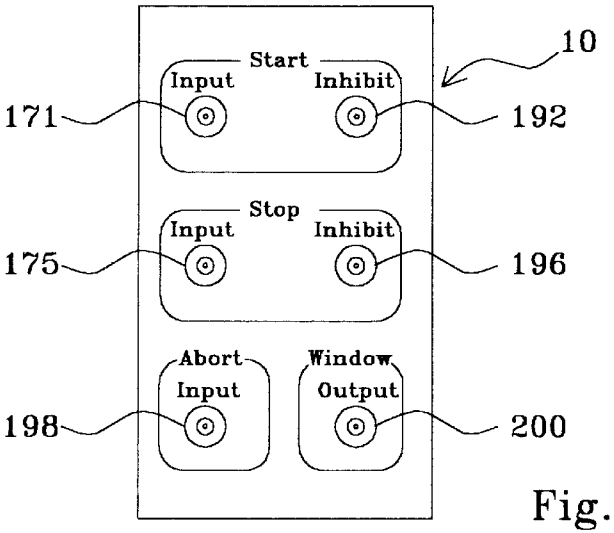
FIG. 8 shows the front panel of the invention and depicts input and output ports.
Figure 1:
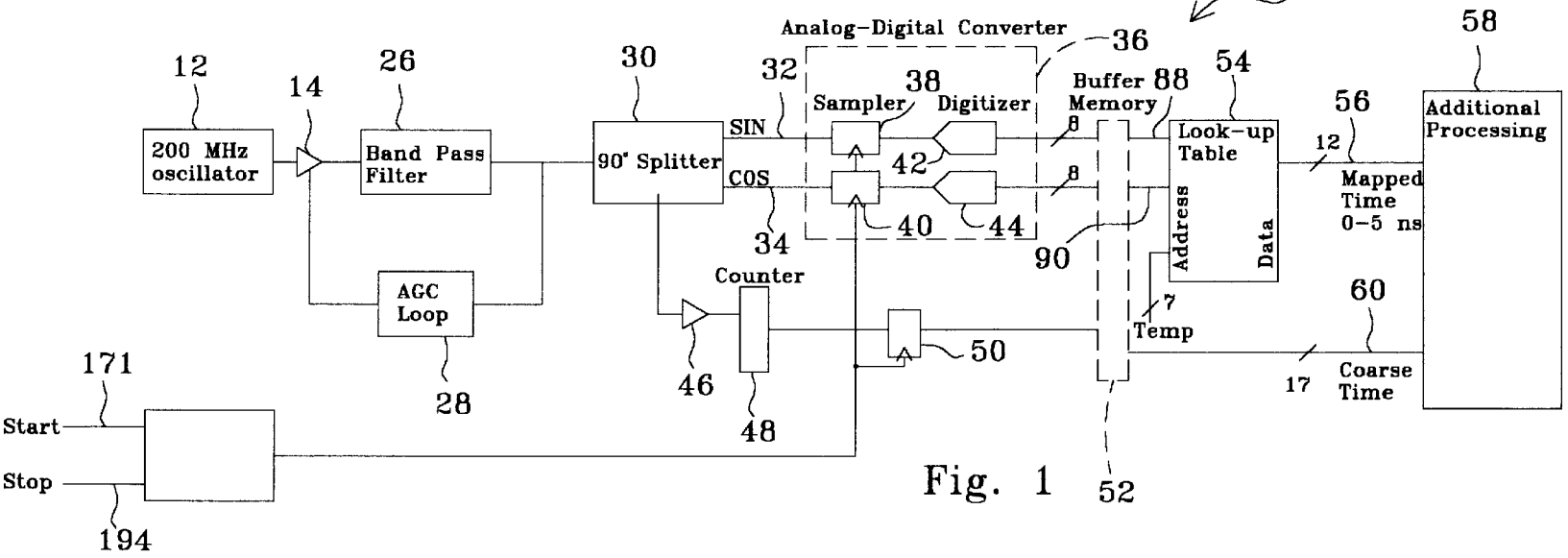
FIG. 1 illustrates a block diagram of a time analyzer having an improved interpolator with temperature compensation and which is constructed in accordance with the various features of the present invention.
Figure 7:
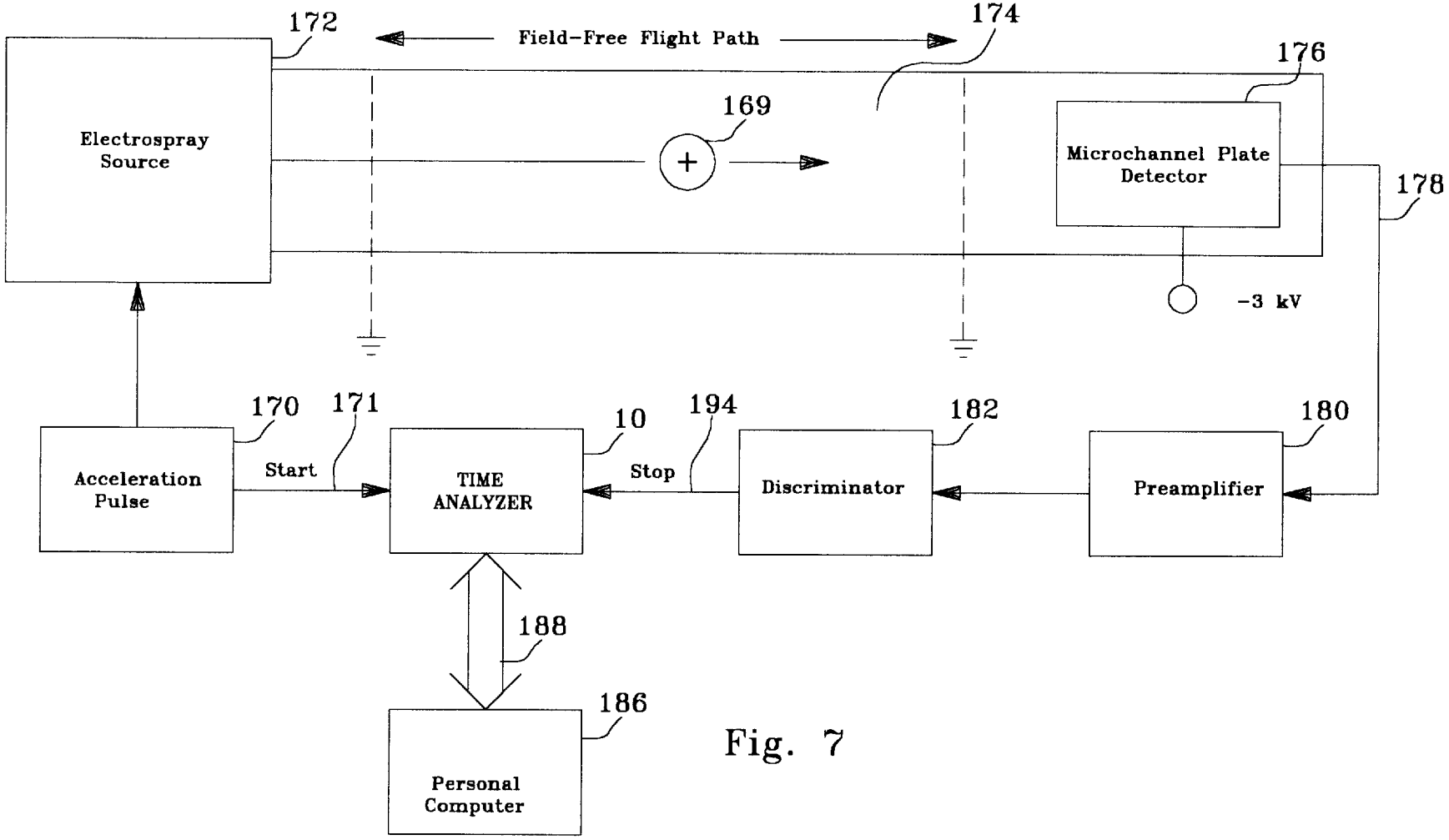
FIG. 7 illustrates a typical application of the present invention connected to a personal computer and used to make measurements for time of flight.

Referring now to the drawings, a time analyzer having an improved interpolator with temperature drift correction constructed in accordance with various features of the present invention is illustrated generally at 10 in FIGS. 1, 7 and 8. The instrument is capable of measuring small time intervals with picosecond precision by interpolating within a cycle of a master clock 12 shown in FIG. 1. In the preferred embodiment, the master clock 12 comprises a 200 MHz oscillator. It will be recognized by those skilled in the art that higher oscillator frequencies produce smaller periods and less interpolation is required to obtain comparable resolutions. However, state of the art electronics requires a balance between the oscillator frequency and parasitic limitations of other components of the analyzer. Moreover, the analyzer may become temperature unstable at excessive oscillator frequencies.

The master clock 12 provides the referenced time base or reference cycle and comprises a crystal oscillator in the preferred embodiment. In certain applications it may be desirable for the oscillator to be ovenized, phase locked or otherwise stabilized. The illustrated master clock comprises an Emitter Coupled Logic (ECL) oscillator which generates a square wave output that is fed through the amplifier 14 into the band pass filter 26. This filter serves to remove the harmonic content of the wave generated by the oscillator of the master clock 12. This band pass filter is more critical in an ECL application than would be the case if a sine wave oscillator were used. However, even if a sine wave oscillator were used harmonics would be generated necessitating the filter 26.

In order to maintain a high quality signal before temperature corrections are made, an automatic gain control (AGC) loop indicated at 28 assists in keeping the amplitude of the output of the band pass filter constant as a function of temperature, mechanical vibrations, and power supply noise. More specifically, the amplitude of the RF signal produced at the output of the band pass filter 26 is stabilized by adjusting the gain of the amplifier 14 which precedes the band pass filter as illustrated. This AGC loop 28 enhances the stability of the output of a band pass filter 26 and assists in reducing the correction factors required during further signal processing.

The splitter 30 receives the output of the band pass filter 26 which comprises a single sinusoid and splits that signal into quadrature signals, i.e., a sine and cosine signals. In the preferred embodiment this splitting is accomplished by a printed delay line which produces a 1.25 nanosecond delay which is the equivalent of 90 degrees (90°) as illustrated on the block diagram. Sine and cosine signals are produced at the outputs 32 and 34, respectively, of the splitter 30.

As a result of external stimulus to be measured, the analog to digital converter (ADC) block 36 samples the voltage of the sine and cosine waves. In the preferred embodiment, the bandwidth of the monolithic digitizers 42, 44 have insufficient input bandwidth and timing resolution, i.e., jitter, to directly sample a high frequency, 200 MHz sinusoidal signal without degrading its sampling accuracy, and hence, a separate sample-and-hold or track-and-hold circuit provides enhanced sampler 38, 40 performance. An Acculin AL1210 track-and-hold circuit was used in the preferred embodiment for the sine and cosine channel samplers. Thus, the samplers 38 and 40 perform a portion of the analog to digital conversion, in that it samples the input and provides the digitizers 42 and 44 additional time to accurately convert the signal to a number which has an 8-bit value, in the preferred embodiment. The 8-bit values for the sine and cosine channels are shown at the outputs of the respective digitizers 42 and 44. It will be noted that the outputs of the splitter 30 is also converted into a digital signal by passing it through the translator 46. In this manner, the integer number of cycles of a reference frequency can be counted providing span greater than the interpolation within a cycle. More specifically, the translator 46 receives the RF sinusoidal signal, and its output feeds the counter 48. This counter counts the integer cycles of the reference frequency. The register 50 copies the current value of the digital counter 48 when the analog-to-digital converter samples the sinusoids, i.e., the sine and cosine waves. Thus, a measurement is made of the internal time of the instrument at which the sample signal was received. The range of that internal time can be adjusted by adding more bits to the counter for measuring longer intervals.

A buffer memory 52 serves to store the preliminary results from the ADC block 36 and the register 50 at a high rate to enable measuring of events which are in close time proximity. These event measurements can be retrieved at slower rates before being fed into the mapping hardware and additional processing.

Block 54 serves as a look up table that maps the sine, cosine, and temperature to produce a 12-bit value representing a fraction of one cycle as indicated at its output 56. That fractional value is combined with the integer number of cycles and is fed into the additional processing block 58 that combines the integer and fractional cycle information and performs relative measurements. More specifically, if an event is labeled as a START event and another event is labeled as a STOP event one can measure the time between the two events by subtracting. This provides the relative time of the STOP with regard to the START which is the information desired from the instrument constructed in accordance with the preferred embodiment. As will be discussed in greater detail hereinbelow, histogram and list modes are also performed in the additional processing block 58.

The integer portion of the internal time is often referred to as "coarse time". The map time is often referred to as "fine time" because it has the smaller time resolution. The mapped time 56 is fed from the output of the look up table 54 into the additional processing block 58. It will be noted that this is a 12-bit value. The coarse time output of the buffer memory 52 is shown at 60 as a 17-bit value which is also fed into the additional processing block 58.

Figure 2:
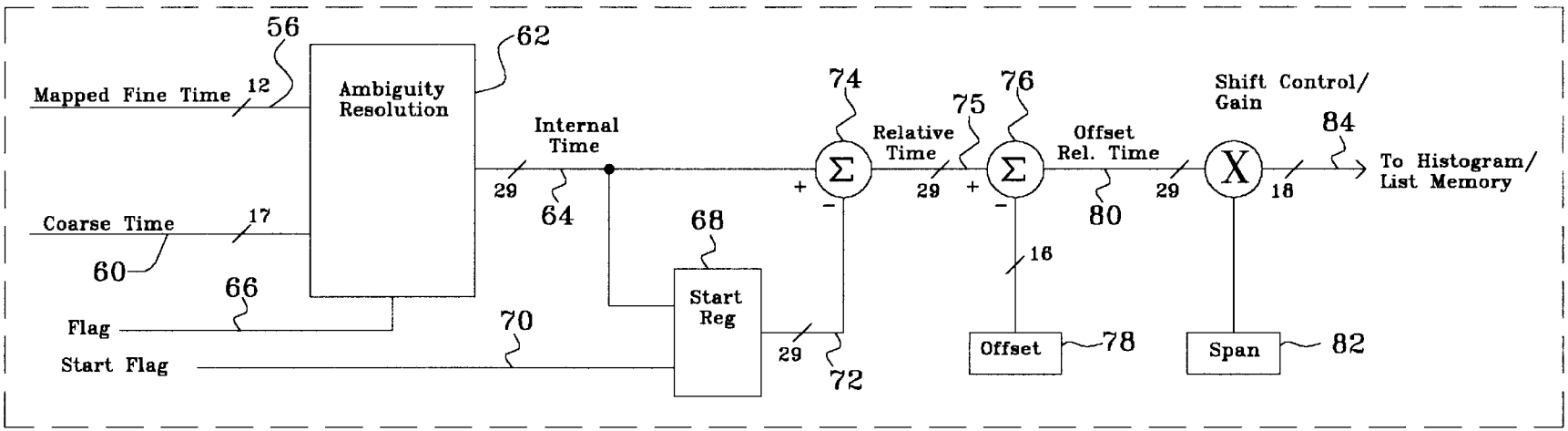
FIG. 2 illustrates a more detailed block diagram of the ADDITIONAL PROCESSING block shown in FIG. 1.

This additional processing block is shown in greater detail in FIG. 2. The mapped time and coarse time are fed into the ambiguity resolution block 62 through inputs 56 and 60, respectively, which are also shown in FIG. 1. The ambiguity resolution block 62 receives the fine time or mapped time together with the coarse time and combines these two values to produce one internal time at 64. It will be noted that this internal time produced at 64 is a 29-bit value. This ambiguity resolution uses the flag bit 66. The flag bit is sampled approximately at the time of measuring the mapped time is used in resolving the ambiguities as to when the coarse time actually increments to make a combined internal time. The ambiguity resolution combines the counter value and the interpolated time to produce one measurement that does not have discontinuity at the cross-over where the cycle completes its circle on a fine time map.

The produced internal time is the time that this event occurs relative to the internal clock of the instrument. If the event is a START event, the instrument stores that internal time in a start register 68 and then the measurements are made relative to this time. It will be noted that the start flag is inputted into the start register at 70 of FIG. 2. The flags traveling with the data indicate whether the event is a START or STOP. The start flag inputted at 70 into the start register indicates that the value of the start register should be updated. This value has the same amount of resolution as the internal time bus 64, which in the preferred embodiment, is approximately 29 bits as indicated at the output 64 of the ambiguity resolution block 62 and the output 72 of the start register 68.

The 29-bit value provides approximately 1.2 picosecond Least Significant Bit (LSB) and covers a span of approximately one (1) millisecond. To calculate the relative time, i.e., the time of an event relative to the most recent START received by the analyzer, the internal time of the previous START is subtracted from the internal time of each STOP measurement. The summation at 74 provides the relative time with respect to the previous START. Thus, the data at 75 does not indicate the internal time of the instrument, but instead indicates the time lapsed since the last START event. This 29-bit word provides the relative time information at the output of the summation 74. It is desirable to reduce the size of this word in order to produce a manageable sized histogram. This is accomplished by eliminating unneeded data at 76 where 16-bit information regarding the offset 78 is applied as shown in FIG. 2. This offset subtracts off time in which it is known no relevant event will occur. In the particular embodiment of the preferred invention, the offset has a 5 nanosecond resolution such that the offset value only needs to be 16 bits to cover all 29 bits of the relative time. This provides offset relative time information at 80. It will be noted that this offset relative time still includes 29-bits of information. The final stage of reducing the width of the data is to shift it and discard unneeded resolution. This is accomplished at the SPAN 82 which holds a multiplier which shifts the information down, discarding insignificant bits to secure a manageable number of bits for the histogram. In the preferred embodiment 16 or 18 bits is a desirable resolution for the histogram, as is shown at 84.

Figure 3:
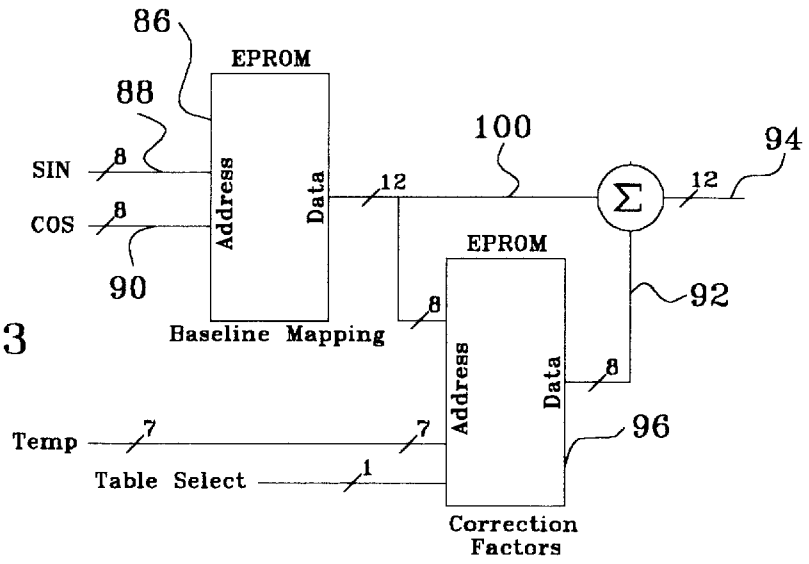
FIG. 3 illustrates a more detailed block diagram of the LOOK UP TABLE IMPLEMENTATION illustrated in FIG. 1.

A more detailed diagram showing the implementation of the look up table 54 is shown in FIG. 3. The EPROM 86 is provided with the sine and cosine 8-bit data buses 88 and 90, respectively, produced at the output of the buffer memory 52. This EPROM 86 is the basic interpolator for room temperature operations that maps the sine and cosine samples into 12-bit mapped time.

In order to make the analyzer work over a given range of temperatures, it is noted that mapping will change as a function of temperature. Thus, mapping is a function of three variables for which proper compensation is not practical with modern day hardware having standard memory. With 8 bits of sine and cosine information, to accomplish a straight look up on the original mapping, 65,536 words of memory are required which is the approximate capacity of current memory available. In order to "look up" as a function of temperature simultaneously a memory that is 128 times larger is required and such a memory is not currently available nor affordable. Accordingly, temperature compensation is accomplished to a satisfactory degree of resolution by utilizing the fact that temperature induced errors vary slowly as a function of temperature, sine and cosine. The primary underlying variables as a function of temperature are the offsets and gains. Thus, the most significant bits of the mapped time can provide information about the angle around the reference circle. Seven bits of measurement temperature information that span the instrument operating range with a slight margin on either end of the range point into another look up table that provides a correction factor as a function of temperature and position within the reference circle. This correction factor is produced at 92 and provides an 8-bit value that spans plus or minus 127 LSB's.

The look up table implementation in FIG. 3 adds a correction factor that accounts for changes as a function of temperature and a 12-bit temperature compensated mapped time is produced as illustrated at 94. It will be noted that there is a chance that the correction value produced at 92 will cause a rollover through zero degrees (0°) apparently changing the number of cycles of the master clock. However, the ambiguity resolution which follows eliminates this potential problem. The EPROM 96 stores correction factors as a function of temperature and mapped time angle.

Figure 4:
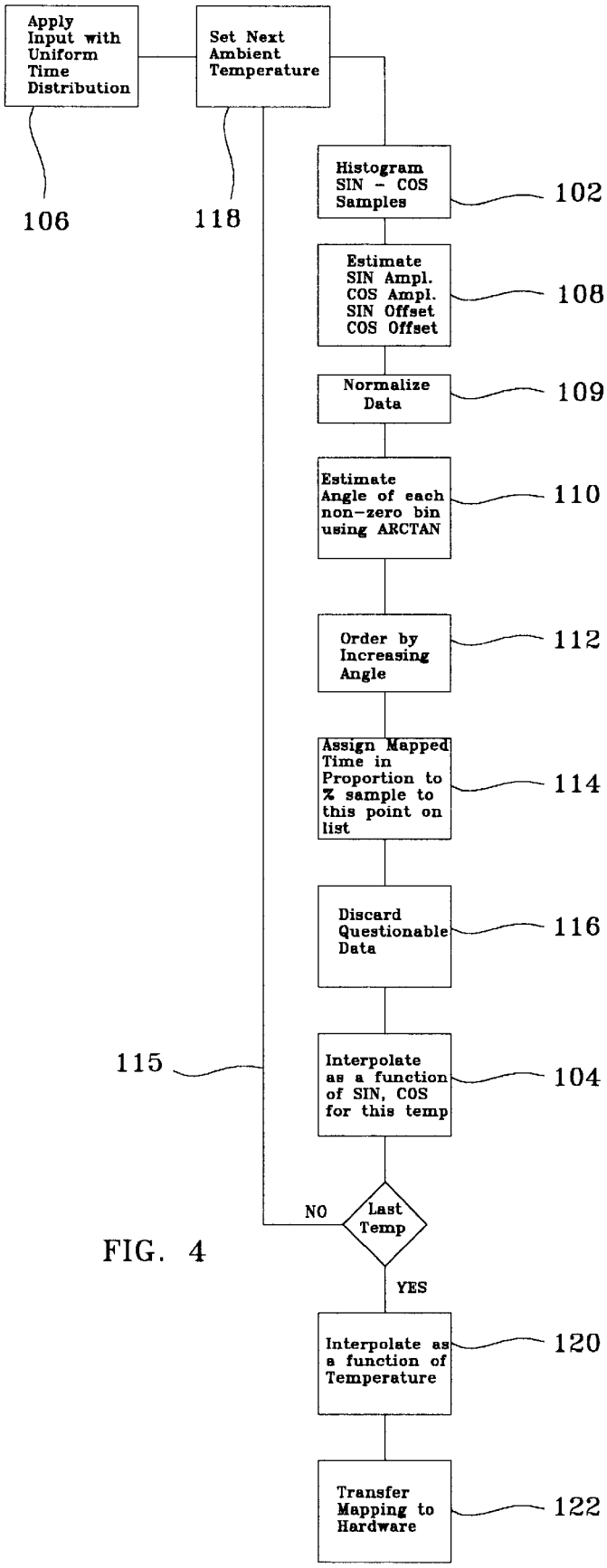
FIG. 4 illustrates a flow diagram of the time analyzer calibration using one mathematical technique referred to as the cumulative probability algorithm for implementing the fine time look up table generation, along with generation of temperature compensation tables.

An overall diagram showing the steps for generating the mapping and compensation tables, from the injection of an input signal to the production of the required mappings is illustrated in FIG. 4. The inner loop 115 of FIG. 4 depicts steps for producing mappings at one temperature, such as the mapping of the main EPROM 86 which takes the sine and cosine signal and gets mapped time at its output 100. This inner loop commences with the collection of histogram sine-cosine samples step 102 and terminates with the interpolate as a function of sine, cosine for this temperature step at 104 by cycling through the entire series of steps shown. FIG. 4 produces the data necessary for building a temperature correction portion of the table. Different methods can be used for building the look up tables including the correction factors. One method utilizes a cumulative probability algorithm which is based upon the fact that a random signal or a sample of uniform time distribution should have a flat histogram within the interpolation interval. That is, it should have an equal probability of being within any particular time band. The first step in this method is to apply an input signal to the instrument that has a uniform time distribution as is shown at 106. This input signal can either be a random signal or a signal that is periodic, but is uncorrelated to the analyzer's internal timing. This signal is generated by an external source.

For calibration of the analyzer, a test pulse generator feeds a test signal into the analyzer as illustrated at 106. Thus, FIG. 4 illustrates the part of the calibration procedure for building the tables to calibrate the instrument. The resulting data is specific to a particular instrument and is generated by putting the instrument into a heat chamber with a controlled temperature. Measurements are then made at three different temperatures in the preferred embodiment. Data is then captured and the sine/cosine samples are histogrammed. The sine and cosine samples are histogrammed directly without going through other processing in the additional processing block 58. The data is collected at the selected temperature for a given period which normally involves a few million samples. After the data collection is stopped the histogram is examined to estimate the sine and cosine amplitudes, together with the estimation of the offsets on the sine and cosine. By estimating the amplitudes and offsets on the sine and cosine, the data can be normalized as is shown at step 109. The angle is estimated from the arctangent of the sine and cosine and this provides the angle within the unit circle. In terms of the Lissajous figure, which is known to those skilled in the art, the sine and cosine sample will define points on a circle in a two-dimensional plane, and by normalizing the amplitudes and offsets the Lissajous figure becomes a unit circle centered at the origin. Step 110 shows that the angle from the cosine axis up to the sample point is estimated using an arctangent function. Next, a one-dimensional list ordered by increasing angles is generated. This one-dimensional list with the sine/cosine pairs ordered according to the angle is calculated by the arctangent from the normalized data. From the histogram the total number of samples collected is known. The cumulative probability algorithm method considers the cumulative probability of having had an angle up to a given point and assigns a time proportional to that fraction which is illustrated at 114. Thus, step 114 illustrates that a mapped time is assigned as a function of the number of samples up to a particular point in time in the list. Questionable data is discarded at step 116 where, for example, some sine/cosine samples may not have many values hit the histogram or the values could be close to one of the angles that did have many hits. Thus, pieces of data with few hits can be discarded at step 116 to avoid biasing of the data. The preferred embodiment uses "less than the average number of hits per bin" as the criterion for declaring data mappings to be questionable and discarding them. For example, if there are 2,000 different sine/cosine pairs that were hit and there are a million pieces of data then any bin with less than one million divided by 2,000 or 500 is discarded. Thus, if a bin has less than 500 hits it is discarded leaving only the ones that had above average number of hits. Thus, only thirty percent (30%) to forty percent (40%) of the data points produce acceptable mapping.

The next step illustrated at 104 shows interpolation as a function of sine/cosine for the particular temperature. Thus, the next step is to interpolate to find what the mapped time would be for other sine/cosine pairs that were either discarded or were never hit. At step 104 all of the different sine/cosine pairs around the circle are interpolated together with the pairs in the vicinity of the circle and the time is then filled in as additional data. That completes the processing, at one particular temperature. The next step is to set a new ambient temperature as is shown at 118. This process is repeated at a selected number of additional temperatures, usually several more temperatures, and the information is stored off on a disk in the preferred embodiment, before being reformatted, burned into EPROM then transferred to the analyzer.

The interpolation at step 104 produces data suitable for EPROM 86. Step 120 computes the differences between the results from step 104 as a function of temperature, interpolates and extrapolates across missing temperatures, and results in the corrections to be embedded in EPROM 96.

In the preferred embodiment, each set of temperature data is stored in the calibration computer and when the calibration is complete, the tables are built. The main sine/cosine look up table is shown at 86 in FIG. 3. The results at step 104 of the internal loop of FIG. 4 at room temperature are stored in the EPROM 86.

The current embodiment shown in FIG. 3 breaks out the temperature correction information from the baseline mapping embedded in EPROM 86. Step 120 is implemented as a difference function from the data in block 86.

Differencing the results from step 104 at other temperatures from the results at room temperature results in the correction factors for EPROM 96. Correction factors for temperatures other than those computed in loop 115 are found by interpolating and extrapolating the measured data.

Thus, the inner loop of FIG. 4 forms the basis of the contents of the memory 86 of FIG. 2. Comparing the mappings of the various temperatures indicates what the correction factor needs to be at the high and low temperature, and such information is stored in memory 96 shown in FIG. 3. There is essentially no correction from the table stored in memory 96 at room temperature because room temperature data is the information in memory 86. An interpolation as a function of temperature and angle within the unit circle can then be used to determine which correction should be made at other temperatures and at each angle of the other temperatures.

It will be noted that the calibration is conducted at different temperatures and in the preferred embodiment three different temperatures are used. As many as five temperatures have been used in the past for calibration purposes, but adequate compensation can generally be produced with three temperature calibrations. Normally, the lowest temperature is used first and each time a new ambient temperature or calibration is set, the processing illustrated through the loop 115 of FIG. 4 is repeated. Once the desired number of calibration temperatures are exhausted, interpolation as a function of temperature, is accomplished at step 120. After the interpolation is completed then the last step of the diagram of FIG. 4 shows that the collected data is ready for being transferred into the hardware, as by burning it in the EPROMs, then embedding those memories into the hardware. It would also be possible to download the information into a EEPROM or into a RAM or through some other technique. However, in the preferred embodiment, the data is burned into the EPROM as is shown at step 122.

It will be noted by those skilled in the art that the cumulative probability algorithm based upon the histogram of time mapped distributions within the interpolation interval being be flat (uniform) when the sampling interval is uncorrelated (e.g.: random) to the instrument's internal time base. In other words, the cumulative probability of a sample being between mapped time 0 and mapped time "X" should match the fraction "X" represents of the full interval being mapped. Hence, when mapping a 5 ns interval, exactly 10% of the samples should fall between 0 and 0.5 ns (or in any other 0.5 ns section).

A separate crystal oscillator was found to work well as a source for the sample interval, yielding high throughput and good results provided oscillators were sufficiently isolated to prevent pulling or attempted injection phase-locking.

In summary, the flow chart of FIG. 4, mapping from SIN,COS to time is computed at each of several temperatures, and corrections for other temperatures are found by interpolation and extrapolation. The results are then programmed into memories and embedded into the instrument, thereby eliminating the need for the instrument to recompute mappings in the field. More specifically, at each temperature, the following algorithm is executed, as indicated by the inner loop of FIG. 4: 1) A significant number of SIN, COS pair occurrences are captured and histogrammed in a two-dimensional plane of SIN vs. COS vs. number of occurrences. 2) SIN amplitude, SIN offset, COS amplitude and COS offset are estimated by observing the histogram statistics. This is most readily done by folding the two-dimensional histogram into two additional one-dimensional histograms, SIN vs. number of occurrences and COS vs. number of occurrences, then computing the mean and standard deviations. 3) A list is made of each SIN, COS pair which occurred, and an angle is assigned to each element. The angle is computed by normalizing the SIN, COS values based on the computed amplitudes and offsets, then performing a four-quadrant ARCTANGENT function. It may be most useful to normalize this result, so it represents a fraction of a full circle (0 to 1.0) rather than in radians or degrees. Prior art would have used this fraction as the mapped time for this SIN,COS pair. 4) Order the list such that SIN,COS pairs are ordered by increasing angle. 5) Assign a mapped time to each element of the reordered list: the mapped time is proportional to the fraction of the total samples which are below it in the list. Hence, when 25% of the samples are below a particular point in the list, the mapped time will be 0.25 (of the interval), or 0.25*5 ns=1.25 ns. 6) Discard elements from the list which are questionable due to a small number of occurrences (e.g.: throw away half or ⅔ of the points, keeping only the ones that had the most histogram hits). This leaves only points that are significant enough to yield accurate mappings. 7) Interpolate time mappings for other SIN,COS pairs in the two dimensional plane which are not kept at step (6). Find the mapped time which is just above and below the point to be mapped, as measured by angle from the origin to the normalized SIN, COS pair being interpolated. Do a linear interpolation proportional to angular difference. At this point, minor nonlinearities within the interpolation interval are ignored, and function is assumed to be well behaved. Some benefit could be obtained by using dynamic Integral Nonlinearity (INL) corrections to the SIN,COS values as part of the normalization process. Dynamic INL information can be extracted by comparing the one-dimensional SIN,COS histograms of step (2) to the ideal cusp distribution which should be expected.

Figure 5:
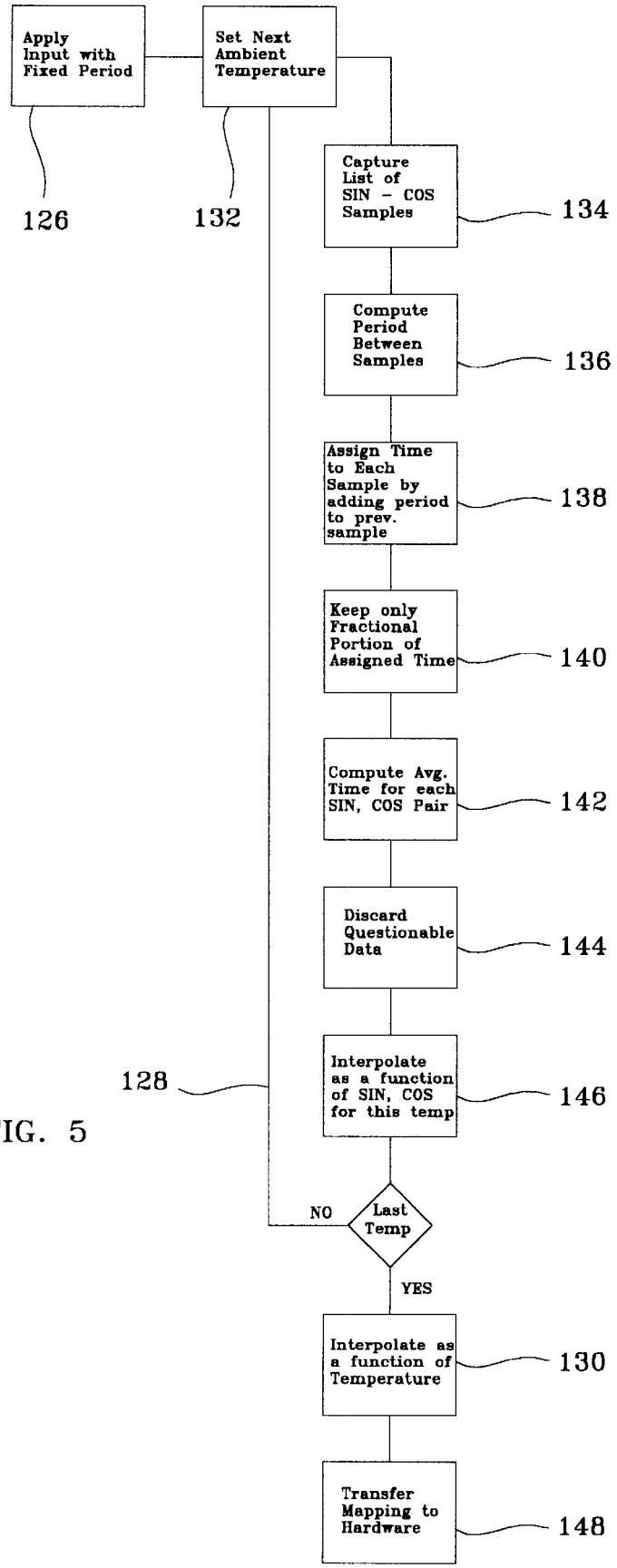
FIG. 5 illustrates a flow diagram of an alternate embodiment of a mathematical technique referred to as the delta time algorithm for implementing fine time look up table generation, along with generation of temperature compensation tables.

An alternate embodiment of a numerical method for producing suitable temperature correction is illustrated in FIG. 5. In the method shown in FIG. 4, the mapping was based on probabilities and leveling of the histogram.

The technique shown in FIG. 5 alternatively, utilizes a signal having a fixed period which is introduced at 126. Thus, every sample is precisely the same distance apart from the previous sample. Again, however, there is an inner loop 128 which generates calibration information at one temperature. Interpolation and extrapolation provides temperature correction as illustrated at block 30 of FIG. 4. But, the inner loop 128 discloses a method substantially different from the method disclosed in inner loop 115 of FIG. 4. More specifically, after the ambient temperature is set as illustrated at block 132, the analyzer is allowed to stabilize at that particular temperature. Here, instead of capturing a histogram of sine and cosine samples as is shown in step 102 of FIG. 4, a list of sine and cosine samples is captured as illustrated at step 134. In the preferred embodiment the list is 65,536 samples long, or 64K samples. Next, the exact period of the externally applied signal is calculated in terms of the internal time base. Thus, after the period of the external source is calculated it is assumed that each successive sample is spaced an equal amount of time beyond the previous sample. The step of assigning time to each sample is illustrated at 138 and is accomplished by adding the period measured in step 136 to the internal time associated with the previous sample. As time is assigned to each of the elements in the list, there will be an integer and fractional number of cycles. The integer information is discarded as is illustrated in block 140 such that only the fractional part of the mapping information is retained. Thus, the concern is only with mapping from the sine/cosine within one cycle. At the next step illustrated at 142, the average time within one cycle of the internal clock that each sine/cosine pair occurred is determined. Generally, for the 64K samples in the list, there will be only about 1,000 or 2,000 different sine/cosine pairs that occurred in that list. The time for each pair is summed and a count is made of how many times that sine/cosine pair occurred. The sum is divided by the number of occurances to find the average time. In a manner similar to step 116 of FIG. 4, questionable data is discarded as is illustrated at step 144.

Step 146 illustrates the interpolation necessary to determine the mapping for the other sine/cosine pairs at this given temperature. Next, the temperature is changed and the steps of loop 128 are repeated. After the calibration information is attained the mapping data is transferred to the memory as illustrated at step 148.

It has been found the mathematical method illustrated in FIG. 4 degrades in the presence of cross talk within the hardware components. This cross talk can make an event which happens at a particular time, appear to happen either earlier or later. In these situations, the mathematical method, illustrated in FIG. 5, may provide better precision by computing the correct average. The disadvantage in using the mathematical method of FIG. 5 is that it is more computationally intensive.

It will be recognized by those skilled in the art that, the delta time algorithm is based upon the fact that the difference between mapped times between samples should be uniform for samples arriving at uniform (constant, fixed) intervals.

As indicated by the flow chart of FIG. 5 from SIN, COS to time is computed at each of several temperatures, and corrections for other temperatures are found by interpolation and extrapolation. The results are then programmed into memories and embedded into the instrument, thereby eliminating the need for the instrument to recompute mappings in the field.

At each temperature, the following algorithm is executed, as indicated by the inner loop of FIG. 5: 1) The mapping process begins with acquisition of a sequential list of SIN, COS pairs taken at fixed time intervals. A crystal oscillator serves as the source of the sample intervals. 2) The period of the sample needs to be determined next. As a practical matter, the sample interval will usually be many full cycles of the reference clock interval, plus a fraction of a cycle. Only the fractional cycle is of real importance to the mapping algorithm. To simplify the processing, frequency drift of both the reference clock and the sample interval is assumed to be negligible during the collection interval, and hence the average fractional cycle portion of the sample interval is found. 3) Time is now assigned to each of the SIN,COS sample pairs in the list. The time for each sample is found by adding the fractional sample interval value to the time for the previous sample pair. 4) For the time values computed in step (3), keep only the fractional cycle portion of the time, and discard the integer cycles. We are only concerned with mapping within one cycle. 5) When a particular SIN,COS pair occurs multiple times in the list, compute the average value computed in step (4) for that SIN,COS pair. 6) Discard SIN,COS pairs which did not occur frequently enough to obtain an accurate average. The remaining SIN,COS pairs now have valid time mappings. 7) Interpolate time mappings for the other SIN,COS pairs in the two dimensional plane which are not kept at step (6). Find the mapped time which is just above and below the point to be mapped, as measured by phase form the origin to the normalized SIN,COS pair being interpolated. Perform a linear interpolation proportional to angle difference. At this point, minor non-linearities within the interpolation interval are ignored, and the function is assumed to be well behaved. Some benefit could be obtained by using dynamic Integral Nonlinearity (INL) corrections to the SIN,COS values as part of the normalization process, if one chooses to compute dynamic INL.

Figure 6:
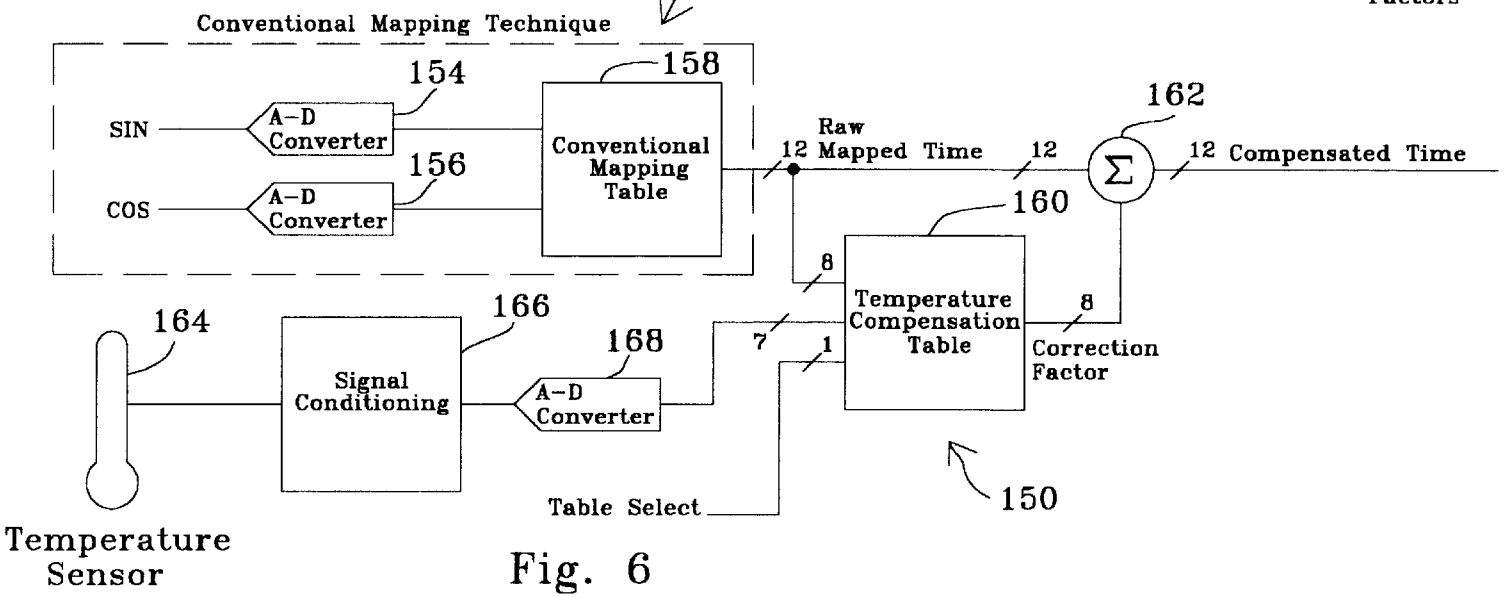
FIG. 6 illustrates the hardware block diagram of the preferred embodiment for implementing the temperature compensation scheme in the mapping block of the analyzer which is based on a sine-cosine interpolator technique for obtaining the fine resolution.

FIG. 6 illustrates a block diagram of a preferred embodiment of the hardware of the present analyzer employing the temperature compensation techniques described above. It will be noted that FIG. 6 depicts the temperature compensation hardware generally indicated at 150 together with its connection with the conventional mapping technique hardware of FIG. 1, shown generally at 152 in FIG. 6. More specifically, the block 152 implements the temperature uncompensated interpolation function. The interpolator uses quadrature samples of the master clock sinusoid to determine time position within a small fraction of the master clock which provides resolution substantially smaller than the master clock interval. Block 154 and 156 obtain the digitized quadrature samples as is illustrated by the analog-to-digital converter nomenclature associated with these blocks. Block 158 implements the conversion from the raw samples to an accurate interpolated time at one particular temperature. With state of the art techniques, parameters which effect the mapping function will drift with temperature and degrade the accuracy of the mapping function. The main parameters which shift with the temperature are the amplitude and offsets of the sampled sinusoids together with the phase shift between the two sinusoids. Harmonic contents of the sinusoids will also change with temperature as will slew rate, linearity and filtering characteristics.

Most temperature induced shifts are gradual functions of temperature and position within the master clock period. The fact that the changes are related to the position within the master clock (interpolation) interval allows the temperature compensation table 160 to be implemented as a function of only two variables which is important from a practicality standpoint.

The analyzer hardware illustrated in FIG. 6 allowed a different 8-bit compensation value for each of 256 different regions within the master clock interval for a given temperature. Compensation sets were included for 128 different temperatures, for a total memory requirement of 32K×8 for a compensation table. The analyzer has two inputs, START and STOP. There are slight differences between each of the inputs, and hence they change slightly differently with respect to temperature. Different temperature compensation tables were constructed for each path, and one real line was added to the look up table 160 for selecting which of the two tables to use, depending on which input created the event being mapped. This raised the memory requirement to 256×128×2×8=65,536×8 bits for this implementation. This two table compensation scheme suddenly allows for one more compensation, namely change in propagation delay between to input sources. This manifests itself as a bias between the average correction value of the two tables. Block 162 adds the correction value to the raw mapped time value to yield a temperature compensated mapped time value.

Referring again to FIG. 6, a temperature sensor 164 is placed near critical components of the analyzer. Normally, the sensor is placed proximate the most temperature sensitive component. In the preferred embodiment, the sensor was a diode connected transistor utilizing the shift in diode voltage with temperature as the sensing technique. The most sensitive components were the Track-and-Hold and the A-to-D blocks, along with the delay line used to form the sine and cosine values shown in block 152. The signal representative of the temperature is fed into the signal conditioner 166 which in the preferred embodiment, consists of a constant current source for biasing the sensor and a Voltage-to-Time integrator circuit for producing a pulse width which was inversely proportional to the sensor voltage.

The digitizer 168 yields a numerical representation of the circuit temperature. When preceded by a Voltage-to-Time converter, this becomes a gated counter running from a fixed clock. Clock rates and choice of bits from the counter were made such that 128 states covered the desired temperature range.

The operation of the invention will now be described in connection with a set up for a time-of-flight experiment as is shown in FIG. 7. A sample to be analyzed is injected into the electrospray source block 172 in a conventional manner. An accelerator pulse illustrated at 170 accelerates the ions 169 in the electrospray source 172. Simultaneously, a START pulse is applied into the START input 171 in FIG. 8 of the time analyzer 10 shown in FIG. 7. The analyzer 10 measures the arrival time of each ion via the STOP input 194. This is accomplished by accelerating the ion towards the microchannel plate detector 176 through the field-free flight path illustrated at 174. The ions strike the detector 176 which generates a pulse at output 178. The time it takes an ion from the application of the acceleration pulse until the particles hit the flight detector 176 is inversely proportional to the mass-charge ratio of the particles in the source 172. Thus, the particles will hit the detector 176 at different times depending on their mass. The pulses generated at output 178 are distributed as a function of the mass of the particle under analysis. This output signal is fed into a preamplifier 180 which serves to amplify the signal to the point such that timing can be measured. The output from the amplifier is fed into the discriminator 182 which converts the amplified analog pulse into a signal suitable to drive the STOP input of the analyzer 10. Thus, the analyzer 10 measures the arrival time of each molecule or ion via the STOP input, and multiple ion flight times can be measured for each acceleration pulse. This process is repeated millions of times in a few minutes with the data being continuously summed. The result is a time spectrogram exhibiting high resolution and dynamic range. The horizontal scale can be calibrated in mass units while the vertical scale measures the relative abundance of each molecular mass.

A personal computer 186 is used to configure the analyzer by inputting information concerning the range over which measurements are made. This computer also provides an output for the analyzer 10 such that the user can observe on its display the results of the histogram of the mass-to-charge ratio of the particles in the sample.

The analyzer 10 and the personal computer 186 are connected through a multi-channel buffer interface (MCB interface) which comprises a 37-pin ribbon cable in the preferred embodiment. It is over this cable generally indicated at 188 through which information concerning the desired configuration of the analyzer 10 is communicated. Moreover, the computer 186 issues a command that tells the instrument 10 to reset the contents of the histogram memory, and configures the range or span, time interval over which measurements are made, and the offset indicating when measurement times are to start. After the configuration is accomplished, the analyzer 10 is operated in a normal mode for measuring STOP times relative to previous START times. The computer also issues a command when the operator is ready to start a measurement which clears out the histogram memory and places the analyzer 10 in a mode for collecting data. Measurements begin with a start signal. Zero or more stop times are measured, until the measurement duration (range) has been exhausted, at which time the instrument waits for the next start pulse. For example, if the instrument 10 is configured to measure 100 microseconds, at the end of 100 microseconds the measurement is complete and then it automatically returns to a mode which is ready to accept the next START for undertaking the next measurement.

FIG. 8 provides a more detailed illustration of the front of a analyzer 10 and depicts its various input and output ports. It will be noted that the START input is shown at 171. The INHIBIT input port is shown at 192, and this allows a user to ignore a particular START if the operator knows that the information is not meaningful. The STOP input is shown at 194, and this port is used to make the other half of the measurement, i.e., the STOP measurement relative to the previously accepted START input. Again, the operator might know under certain conditions in an experiment that a particular STOP pulse is not going to be meaningful this can be inhibited through port 196.

In the normal sequence of events, a START pulse starts a measurement pass and a preconfigured offset time is allowed to pass before histogram data is commenced to be collected. This time is determined by the offset configuration selected by the user. The analyzer collects data over a preselected time interval called the span and normally after the START signal is input through port 171 the analyzer 10 will run through an entire cycle of its process. If the user desires to stop collecting data before the range or span time interval passes an abort input can be injected into 198. It will also be noted on the face of the analyzer 10 there is a WINDOW output 200 which provides bounds about the interval over which valid data is collected. For example, if there is an OFFSET indicating a time delay of a given amount before the analyzer 10 starts collecting data, the WINDOW will wait slightly less than that interval of time before going active and then stay active for the duration of the data collection, then cause the instrument to go inactive after the collection is complete. Once the instrument is inactive, it is ready to receive the next START input to start the next measurement sequence.

From the foregoing detailed description, it will be recognized by those skilled in the art that a time analyzer having an improved interpolator with temperature compensation has been described and illustrated. The analyzer provides high precision time measurement to be taken within a wide operating temperature range without the need for recalibration in the field. Moreover, the analyzer of the present invention allows greater precision to be achieved over a selected temperature range without placing restrictions on the minimum sample throughput.

It is, of course, understood that although preferred embodiments of the present invention have been illustrated and described, various modifications thereof will become apparent to those skilled in the art, and, accordingly, the scope of the present invention should be defined only by the appended claims and equivalents thereof.

I claim:

1. A time analyzer for measuring event times with high precision comprising:

an input for receiving a plurality of electronic pulses representing start and stop times of events into the time analyzer;

a master clock for generating a reference frequency signal;

translating and counting circuitry for making a coarse time measurement of the internal time of the time analyzer at which said pulses are received wherein said coarse time measurement is made in an integral number of cycles of the master clock;

a fine time interpolator for determining the time within a single cycle of a master clock period at which the events occur, said time being determined based upon two quadrature signals derived from sinusoids; and, a temperature compensator for performing a temperature compensation based on an arbitrary mapping function for correcting fine time measurements made by the analyzer whereby said analyzer produces time measurements which are accurate across a wide band of temperatures, said quadrature signals for determining an uncorrected fine time, said arbitrary mapping function determining a correction factor by mapping said uncorrected fine time and a temperature of the environment in which said time analyzer is employed and applying said correction factor to said uncorrected fine time to determine said corrected fine time measurements.

2. The time analyzer of claim 1 wherein said temperature compensation produces measurement corrections which adjust for temperature induced drifts such as amplitude, dc offset and phase shifts.

3. The analyzer of claim 2 wherein said temperature corrections are a function of the drifts unique to the analyzer used for making measurements.

4. The time analyzer of claim 1 wherein said temperature compensator comprises circuitry and interconnected memory storing compensation data which is selectively applied to correct measurements made by the analyzer.

5. The time analyzer of claim 1 wherein said temperature compensator comprises look up tables for performing the arbitrary mapping function based on three variables.

6. The time analyzer of claim 5 wherein first and second look up tables perform two successive two dimensional mappings to obtain a temperature compensated result based on the three variables.

7. The time analyzer of claim 6 wherein said first look up table maps two of the three variables to obtain a first result and said second look up table maps the remaining of the three variables and said first result to obtain said temperature compensated result.

8. A method for analyzing time with improved precision comprising the steps of:

receiving a plurality of electronic pulses representing start and stop times of events into a particular analyzer;

dividing a single cycle of a master clock of said particular analyzer using two quadrature signals from sinusoids from which said start and stop times are determined;

observing shifts in uncompensated measurements for said pulses over temperature for said particular analyzer;

building a correction table by storing data proportional to said observed shifts in uncompensated measurements for said calibration samples; and, applying calibrated correction factors to the actual measurements made by said particular analyzer based on a mapping function of said correction table whereby measurement results include temperature compensation unique to said particular analyzer, said step of applying calibrated correction factors comprising the steps of:

mapping an orthogonal voltage sample of each of said quadrature signals to determine a fine time output;

mapping said fine time output and a temperature of the environment in which said particular time analyzer is employed through a look-up table to determine a correction factor; and correcting said start and stop times for temperature-induced errors using said correction factor.

9. The method of claim 8 wherein said mapping function is an arbitrary mapping function.

10. The method of claim 8 wherein said mapping function comprises the step of performing two successive two dimensional mappings based on three variables to obtain the temperature compensated result.

11. The method of claim 8 wherein said mapping function is a non-arbitrary mapping function.

12. A method for analyzing time with improved precision comprising the steps of:

receiving a plurality of electronic pulses representing start and stop times of events into a particular time analyzer;

generating a reference frequency signal by a master clock for said particular time analyzer;

making a fine time interpolation to determine the time within said master clock when said events occurred, said step of making a fine time interpolation including the step of dividing a single cycle of a master clock of said particular analyzer using two quadrature signals from sinusoids from which said start and stop times are determined; and, producing and applying temperature compensation factors for observed temperature drifts to said fine time made by said particular time analyzer based on an arbitrary mapping function whereby the time analysis resulting from said method is adjusted by temperature compensation, said step of producing and applying temperature compensation factors including the steps of:

mapping an orthogonal voltage sample of each of said quadrature signals to determine a fine time output;

mapping said fine time output and a temperature of the environment in which said particular time analyzer is employed through a look-up table to determine a correction factor; and correcting said start and stop times for temperature-induced errors using said correction factor.

13. The method of claim 12 wherein said arbitrary mapping function comprises the step of performing two successive two dimensional mappings based on three variables to obtain the temperature compensated result.

14. A method for analyzing time with improved precision comprising the steps of:

receiving a plurality of electronic pulses representing start and stop times of events into a particular time analyzer;

generating a reference frequency signal by a master clock;

making a coarse time measurement of the internal time of said particular time analyzer at which said pulses are received for said events occurring within a cycle of said master clock;

adjusting said coarse time measurement with a fine time interpolation to determine when said events occurred within said master clock cycle, said fine time interpolation including the step of dividing a single cycle of a master clock of said particular analyzer using two quadrature signals from sinusoids from which said start and stop times are determined; and, producing and applying temperature compensation factors based on a mapping function for observed temperature drifts to said fine time for said particular time analyzer whereby said time analysis is adjusted by temperature compensation, said step of producing and applying temperature compensation factors including the steps of:

mapping an orthogonal voltage sample of each of two quadrature signals defined by a single cycle of a master clock of said analyzer to determine a fine time output;

mapping said fine time output and a temperature of the environment in which said particular time analyzer is employed through a look-up table to determine a correction factor; and correcting said start and stop times for temperature-induced errors using said correction factor.

15. The method of claim 14 wherein said arbitrary mapping function comprises the step of performing two successive two dimensional mappings based on three variables to obtain the temperature compensated result.

16. The method of claim 14 further comprising a time analyzer for analyzing time and wherein said temperature compensation factors are unique to the particular analyzer.

17. A method for manufacturing a time analyzer for measuring event time with high precision comprising the steps of:

receiving a plurality of electronic pulses representing start and stop times of events into said analyzer;

calibrating said analyzer by producing temperature correction data unique to said analyzer;

storing said temperature correction data in a memory such that said temperature correction data can be applied when said analyzer is used in measuring the time of said events; and performing a mapping function on said temperature compensation data whereby resulting measurements include temperature compensation unique to said analyzer, said step of performing a mapping function including the steps of:

mapping an orthogonal voltage sample of each of two quadrature signals defined by a single cycle of a master clock of said analyzer to determine a fine time output;

mapping said fine time output and a temperature of the environment in which said analyzer is employed through a look-up table to determine a correction factor; and correcting said start and stop times for temperature-induced errors using said correction factor.

18. The method of claim 17 wherein said arbitrary mapping function comprises the step of performing two successive two dimensional mappings based on three variables to obtain the temperature compensated result.

19. A method of analyzing time with improved precision comprising the steps of:

receiving a plurality of electronic pulses representing start and stop times of events into a particular time analyzer;

generating a reference frequency signal by a master clock for said particular time analyzer;

making a fine time interpolation to determine the time within said master clock when said events occurred, said step of making a fine time interpolation including the step of dividing a single cycle of a master clock of said particular analyzer using two quadrature signals using sinusoids from which said start and stop times are determined; and, applying a delta time algorithm for calculating fine time mapping functions for said particular time analyzer.

* * * * *